US012654917B2

(12) United States Patent
Sibley et al.

(10) Patent No.: US 12,654,917 B2
(45) Date of Patent: Jun. 16, 2026

(54) SECURING DEVICES FOR CONTAINERS AND OTHER STRUCTURES

(71) Applicant: ARRIS Enterprises LLC, Suwanee, GA (US)

(72) Inventors: Keith E. Sibley, North Wales, PA (US); Jamie J. Swift, Levittown, PA (US); Julio Cesar Ayala Vera, Apodaca (MX); Carlos Paul Gonzalez Inda, Guadalupe (MX); Hector J. Hevia, Apodaca (MX)

(73) Assignee: ARRIS Enterprises LLC, Horsham, PA (US)

( * ) Notice: Subject to any disclaimer, the term of this patent is extended or adjusted under 35 U.S.C. 154(b) by 200 days.

(21) Appl. No.: 18/282,988

(22) PCT Filed: Mar. 18, 2022

(86) PCT No.: PCT/US2022/021028

§ 371 (c)(1),
(2) Date: Sep. 19, 2023

(87) PCT Pub. No.: WO2022/198095

PCT Pub. Date: Sep. 22, 2022

(65) Prior Publication Data

US 2024/0175455 A1 May 30, 2024

Related U.S. Application Data

(60) Provisional application No. 63/163,043, filed on Mar. 19, 2021.

(51) Int. Cl.
*B65D 55/02* (2006.01)

(52) U.S. Cl.
CPC ..... *B65D 55/02* (2013.01); *B65D 2251/1058* (2013.01)

(58) Field of Classification Search
CPC . B65D 55/02; B65D 55/10; B65D 2251/1058
See application file for complete search history.

(56) References Cited

U.S. PATENT DOCUMENTS

2006/0153516 A1* 7/2006 Napiorkowski ..... H04Q 1/028 385/134

FOREIGN PATENT DOCUMENTS

DE 4125136 A1 * 12/1991 ..... B60R 9/055
EP 0563029 A1 * 9/1993 ..... B65D 90/008

OTHER PUBLICATIONS

International Search Report and Written Opinion RE: Application No. PCT/US2022021028, dated Jun. 14, 2022.

* cited by examiner

*Primary Examiner* — Javier A Pagan
(74) *Attorney, Agent, or Firm* — Chernoff, Vilhauer, McClung & Stenzel, LLP

(57) ABSTRACT

Securing devices are shown and disclosed. In one embodiment, the securing device includes a threaded member movably attached to a first structure. The securing device additionally includes a receptacle attached to a second structure. The receptacle defines an opening sized to receive a portion of the at least one threaded member. The securing device further includes a fastener having an aperture with corresponding threads to receive the threaded member. The fastener additionally includes a handle portion sized to be grasped in the palm of a user's hand to move the fastener between a secured position in which the fastener contacts the receptacle when the portion of the at least one threaded member is received in the opening to secure the threaded member to the receptacle and to secure the first and second structures together, and an unsecured position in which the fastener is spaced from the receptacle.

12 Claims, 8 Drawing Sheets

SECURING DEVICES FOR CONTAINERS AND OTHER STRUCTURES

CROSS REFERENCE TO RELATED APPLICATIONS

This application is a 371 National Stage Patent Application which claims priority to PCT International Patent Application No. PCT/US22/21028, filed Mar. 18, 2022, which claims the benefit of U.S. Provisional Patent Application Ser. No. 63/163,043 filed Mar. 19, 2021.

BACKGROUND

The subject matter of this application relates to securing devices for structures, such as containers, other enclosures, and non-enclosure structures for cable (e.g., fiber optic cable) and/or power lines. The aerial installation and repair of cable and/or power lines require personnel to work at hazardous heights. Additionally, it generally is difficult for personnel to handle tools with just one hand because the other hand generally is occupied in performing other tasks.

What is desired, therefore, are securing devices that can be at least partially secured with just one hand and that can be further tightened and/or secured via a single hand tool.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
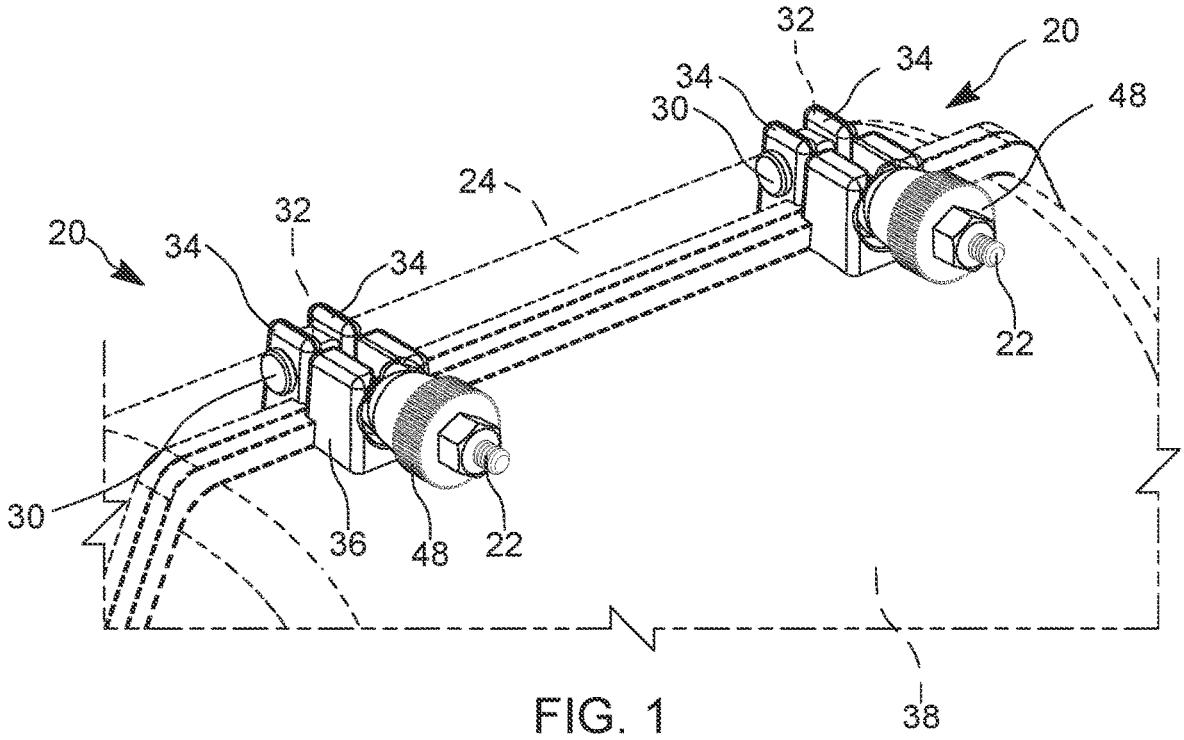
FIG. 1 is an isometric view of an example of a securing device shown in a secured configuration.
Figure 2:
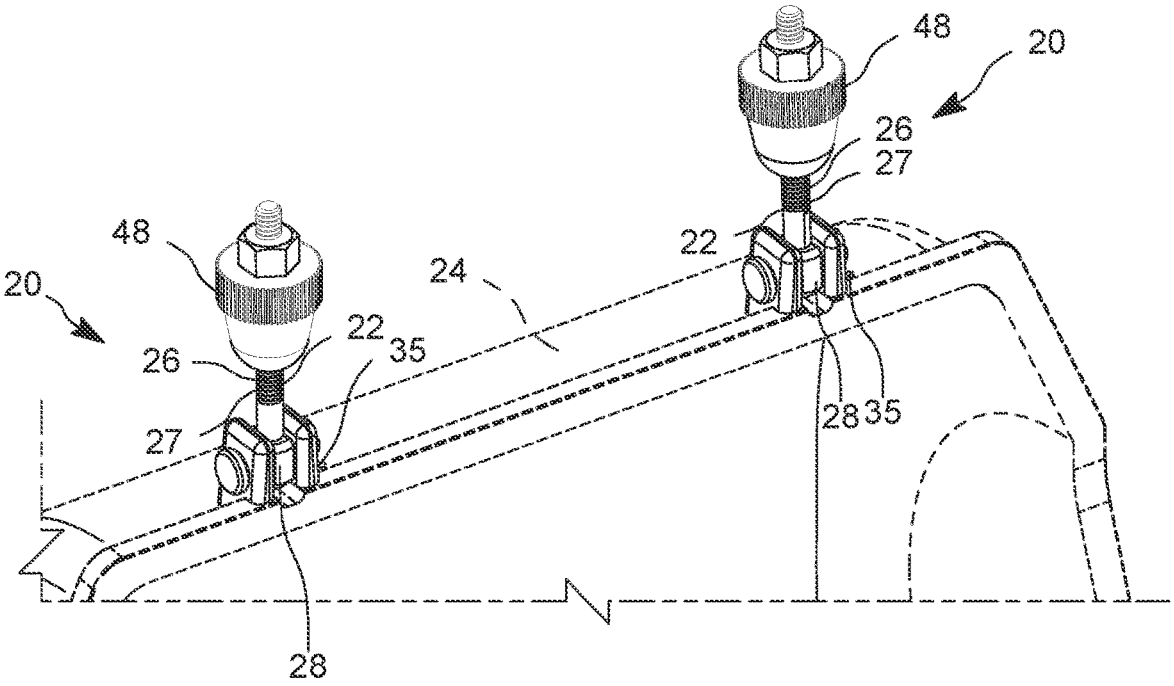
FIG. 2 is an isometric view of an example of the securing device of FIG. 1 shown in an unsecured configuration.

Referring to FIGS. 1-2, an example of two securing devices 20 is shown. Each securing device 20 includes a threaded member 22 that is movably attached to, for example, a first structure 24. The threaded member includes a threaded portion 26 having threads 27 and a loop or connector portion 28 that is movably attached to the first structure. An example of a suitable threaded member is a threaded eye bolt. However, other threaded members may be used. In the example shown in FIGS. 1-2, the threaded member is pivotably attached to first structure 24 via bolts 30 received in pivot holes 32 of extensions 34 of first structure 24. Additionally, cotter pins 35 secure bolts 30 in pivot holes 32 However, threaded member 22 may alternatively be pivotably attached via screw and nut and/or other suitable structure(s).

Figure 3:
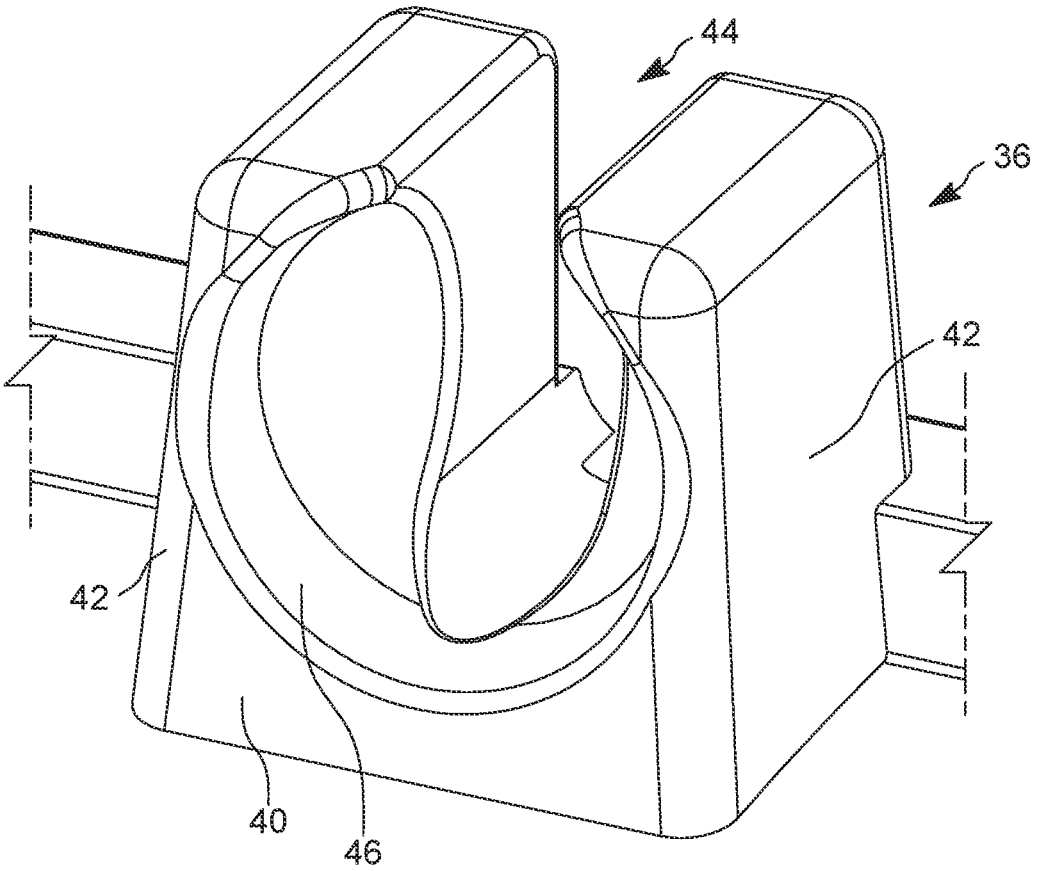
FIG. 3 is an example of a receptacle of the securing device of FIG. 1.

Each securing device 20 additionally includes a receptacle 36 that is attached to (or formed with), for example, a second structure 38. Referring to FIG. 3, the receptacle 36 includes a receptacle base 40 attached to, or formed with, second structure 38 and two spaced-apart leg members 42 that extend from receptacle base 40 and that define an open cut or receptacle opening 44 therebetween. Receptacle opening 44 is sized to receive a portion of threaded member 22, such as when threaded member is moved or pivoted toward opening 44 of receptable 36. In the example shown in FIG. 3, receptacle 36 also includes a cavity 46 collectively formed by depressions in the base and leg members. Receptacle opening 44 and cavity 46 are connected with each other (or in fluid communication with each other). The cavity is shaped to receive an end portion of a fastener as further discussed below. In the example shown in FIG. 3, cavity 46 has a shape that receives an end portion that has a generally hemispherical or half-ball shape. The shape of cavity 46 is particularly significant because it can receive a fastener (further discussed below) in various misaligned directions and align the fastener in the desired angle. In other words, cavity 46 provides a self-alignment feature for the fastener via cavity 46. Receptacle 36 may sometimes be referred to as a "half-ball female shape receptacle."

Figure 5:
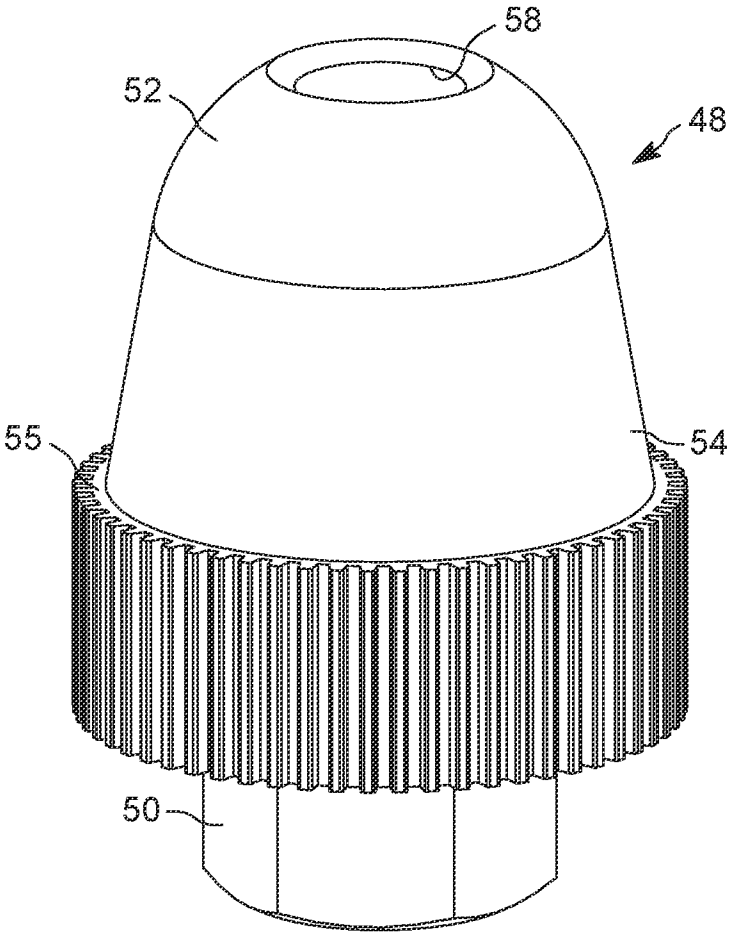
FIG. 5 is another isometric view of the fastener of FIG. 4.
Figure 4:
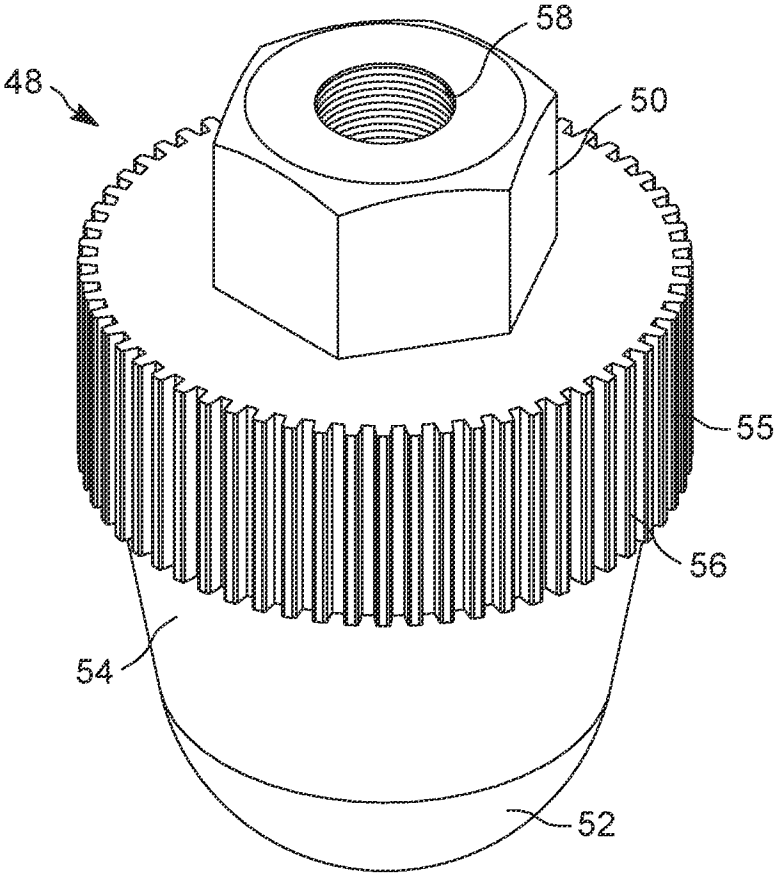
FIG. 4 is an isometric view of an example of a fastener of the securing device of FIG. 1.
Figure 6:
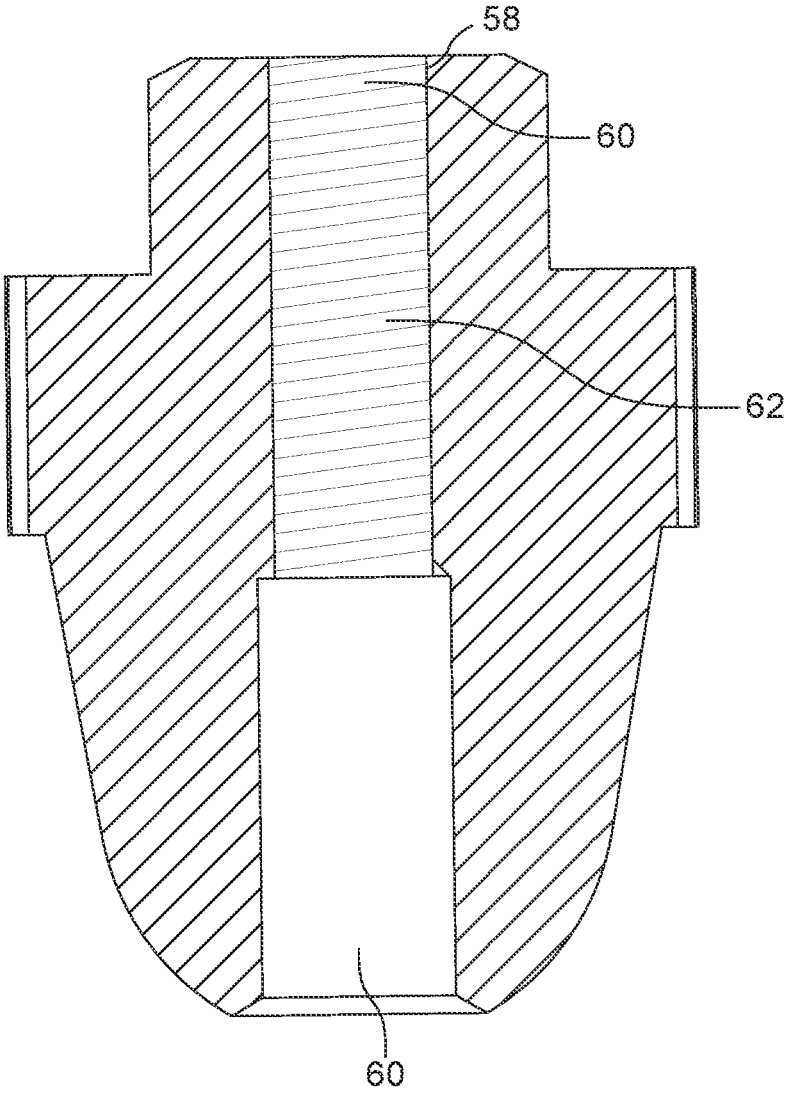
FIG. 6 is a sectional view of the fastener of FIG. 4 taken along lines 6-6 of FIG. 4.
Figure 7:
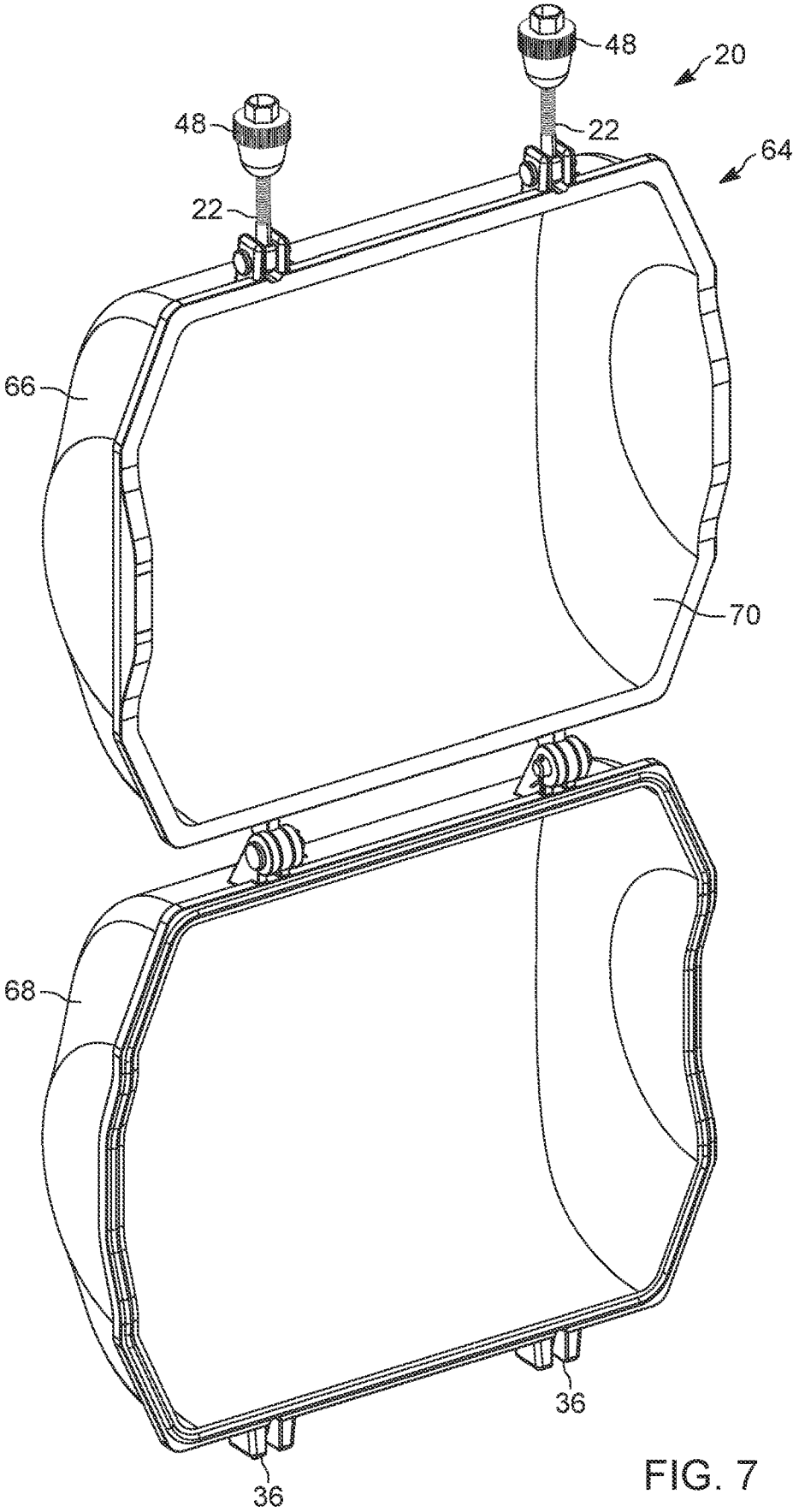
FIG. 7 is an isometric view of an example of a cable enclosure having the securing device of FIG. 1, the securing device shown in an unsecured configured.

Each securing device 20 further includes a fastener 48. The fastener is selectively attached to or detached from threaded member 22. In the example shown in FIGS. 4-6, fastener 48 is selectively threaded on or unthreaded off threaded portion 26 of threaded member 22. Fastener 48 includes a first end portion 50, a second end portion 52, and a central portion 54 disposed between the first and second end portions. The first end portion is shaped as a nut, such as a hex nut, to allow a user to tighten fastener 48 with a wrench. For example, a user may position the wrench such that its jaws receive first end portion 50. First end portion 50 may also be referred to as a "nut portion." Fastener 48 may sometimes be referred to as a "knob" or a "half-ball male-shaped knob nut."

Second end portion 52 is shaped to be received in cavity 46 of receptacle 36. In the example shown in FIGS. 4-6, second end portion 52 has a generally hemispherical or half-ball shape that corresponds with the shape of cavity 46. Central portion 54 is shaped and sized to be grasped in the palm of a user's hand and thus may sometimes be referred to as a "handle portion." In some examples, the central portion may be shaped and sized to be grasped in the palm of a user's hand wearing thick gloves. In the example shown in FIGS. 4-6, central portion 54 has a generally frustoconical shape. Central portion 54 also includes a band 55 having a plurality of ridges 56. The plurality of ridges 56 may be in the form of a knurl having a straight pattern or other suitable pattern. The ridges may have any suitable pitch and depth.

Fastener 48 additionally includes an aperture 58 that extends along the entire height of the fastener, between first and second end portions. In the example shown in FIGS. 4-6, aperture 58 receives an insert 60 with threads 62 that correspond with threads 27 of threaded member 22 such that threaded portion 26 is received in insert 60. When threaded portion 26 is received in insert 60, threads 27 and 62 allow a user to move fastener toward and away from receptacle 36 between a secured position and an unsecured position. In the secured position, second end portion 52 is received in cavity 46 and/or is in contact with receptacle 36 to secure the first and second structures together. In the unsecured position, second end portion 52 is spaced from cavity 46 of receptacle 36. Although fastener 48 shown in the example of FIGS. 4-6 includes insert 60 with threads 62, other examples of fastener 48 may exclude insert 60 and may instead include threads 62 that are formed along the internal walls that define aperture 58.

First structure 24 and second structure 38 may be any suitable structures that one or more securing devices 20 secure together. In some examples, the first and second structures may be enclosure portions that at least partially or fully define one or more enclosures therebetween, such as a container, a fiber management tray, a cable positioner, etc. For example, the first and second enclosure portions may be movably connected (e.g., pivotably, slidably, etc.) such that those portions move between a closed position in which the first and second enclosure portions are adjacent to each other to at least partially define an enclosure therebetween, and an open position in which the first and second enclosure portions are spaced from each other relative to the closed position. In other examples, the first and second structures do not partially or fully define one or more enclosures, which may be referred to as non-enclosure structures or non-enclosure portions.

Figure 8:
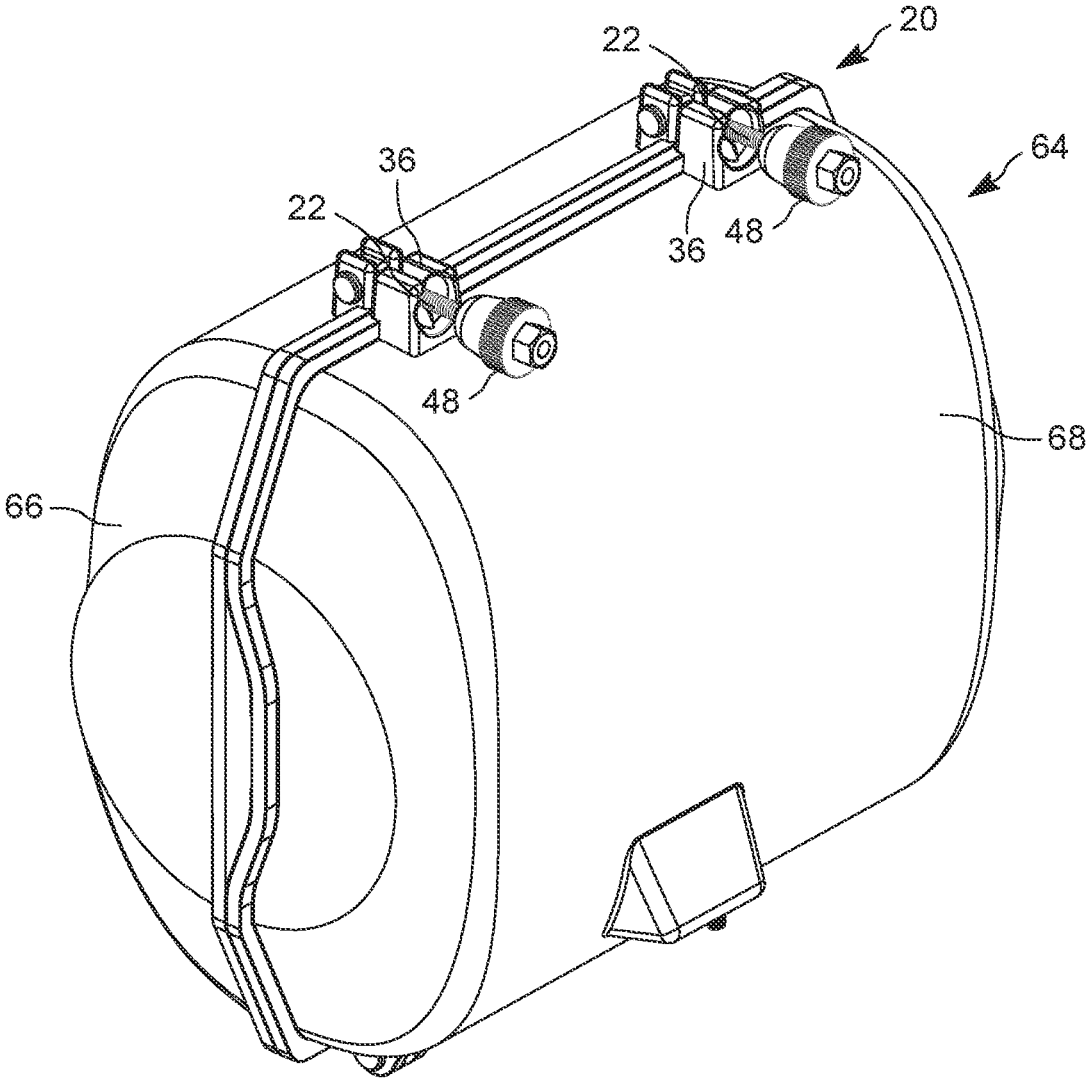
FIG. 8 is an isometric view of the example of the cable enclosure of FIG. 7 shown with the securing device in a received configuration.
Figure 9:
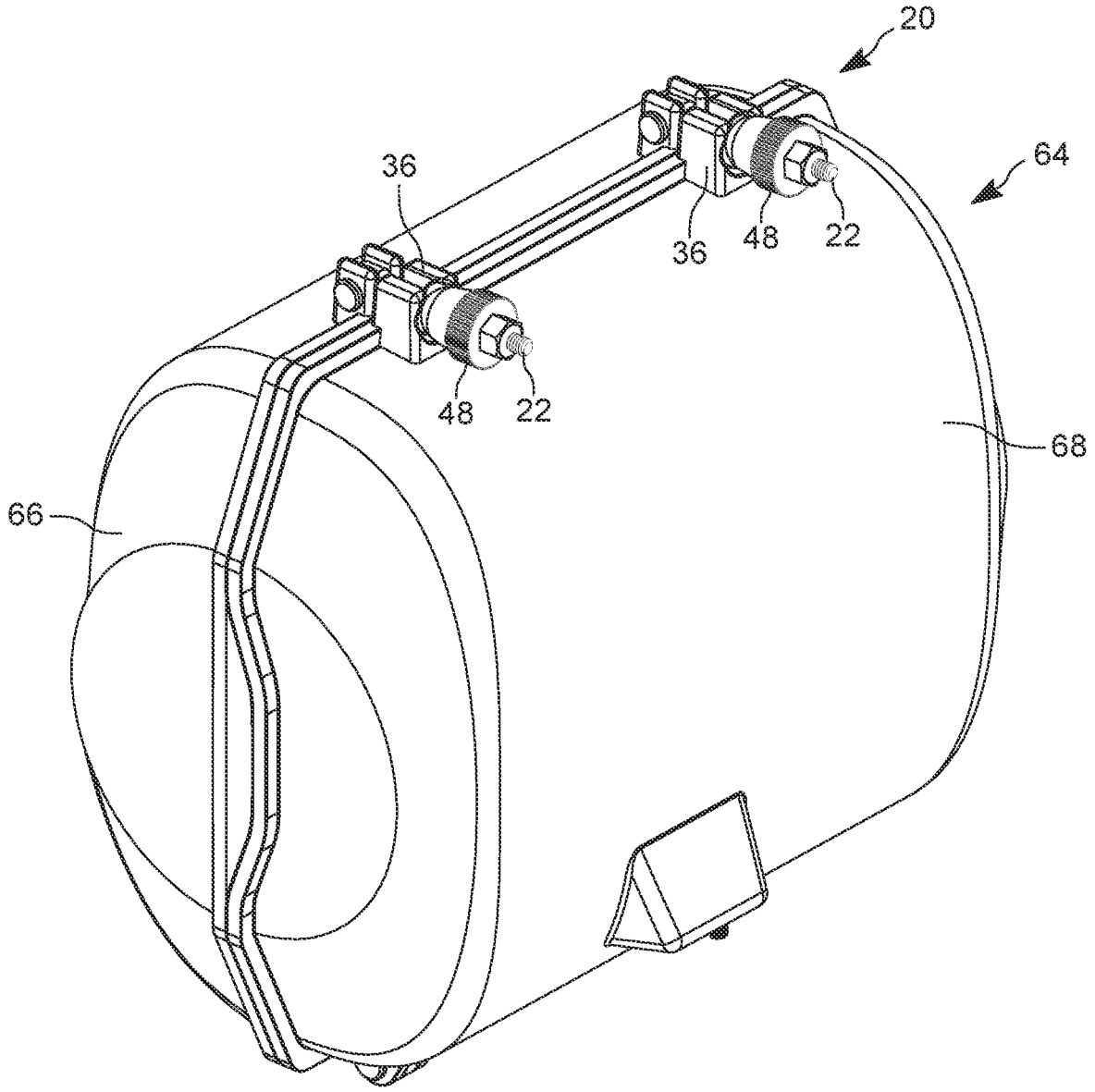
FIG. 9 is an isometric view of the example of the cable enclosure of FIG. 7 shown with the securing device in a secured configuration.
Figure 10:
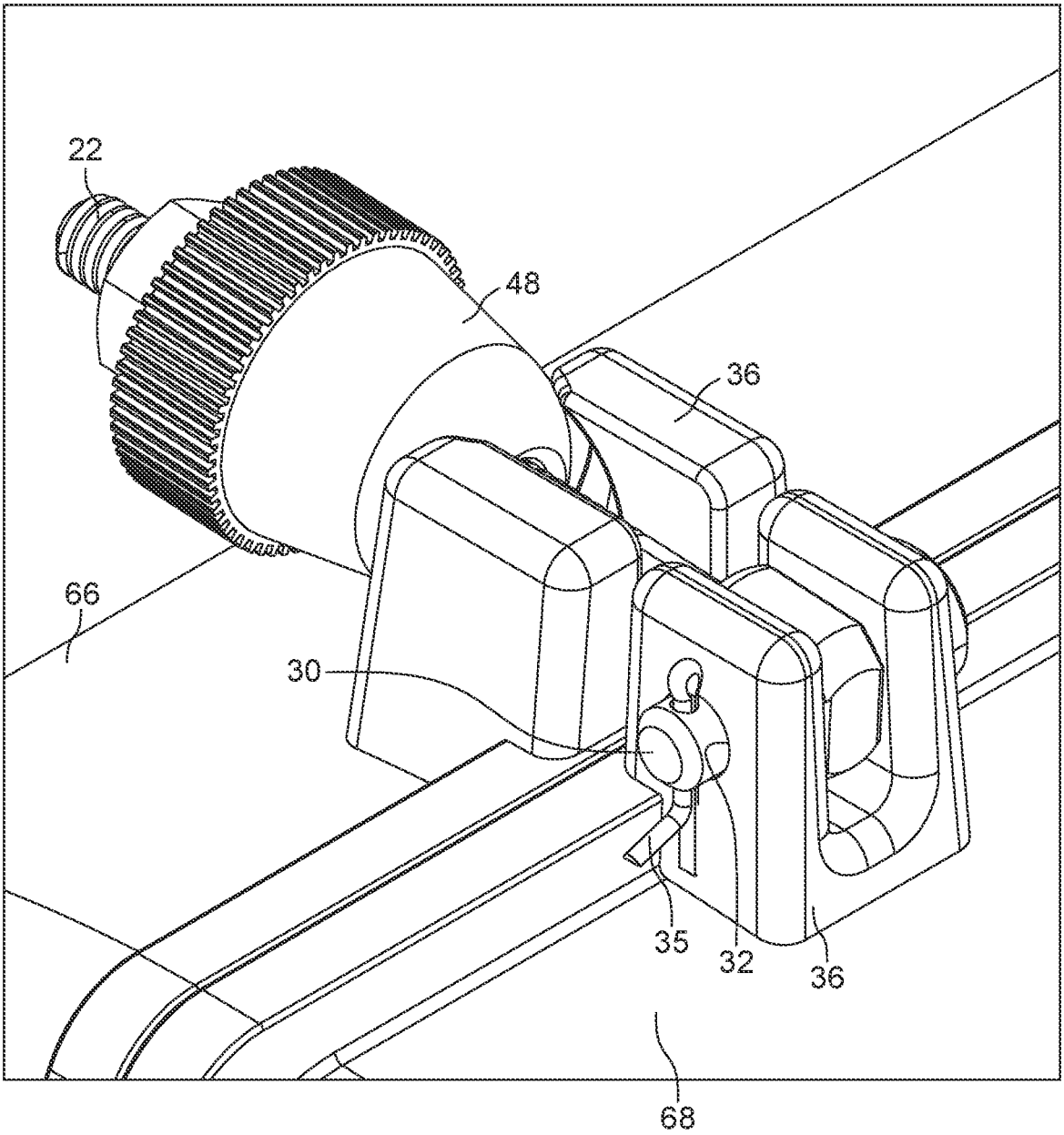
FIG. 10 is a partial isometric view of the example of the cable enclosure of FIG. 9 with the securing device in the secured configuration.

Referring to FIGS. 7-10, securing devices 20 are associated with a cable container 64 having a first enclosure portion 66 pivotably connected to a second enclosure portion 68. The first and second enclosure portions pivot between an open position (shown in FIG. 7) and a closed position (shown in FIG. 8). In the closed position, the first and second enclosure portions define an enclosure 70 therebetween. A user can move second enclosure portion 68 from the open position (shown in FIG. 7) to the closed position by pivoting the second enclosure portion toward the first enclosure portion. Once in the closed position, a user can pivot threaded members 22 toward receptacles 36 such that the threaded members are received in openings 44 of the receptacles, as shown in FIG. 8. The user can then rotate fasteners 48 toward receptacles 36 until second end portions 52 are received in cavities 46 of the receptacle to secure the first and second enclosure portions together, as shown in FIGS. 9-10. The user also can use a wrench around the nut portion of the fasteners to further tighten the fasteners.

The securing devices of the present disclosure provide a user with the ability to secure first and second structures together with only one hand through a thick glove and/or only a single tool, such as a wrench. In other words, the securing devices of the present disclosure provide one-handed operation of securing first and second structures, such as first and second enclosure portions, together. Other advantages of the present disclosure include good stress distribution, reduced time for installation and replacement, less effort, and improvement of work quality.

It will be appreciated that the invention is not restricted to the particular embodiment that has been described, and that variations may be made therein without departing from the scope of the invention as defined in the appended claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

The invention claimed is:

1. A securing device, comprising:

a threaded member movably attached to a first structure;

a receptacle attached to a second structure, the receptacle defining an opening shaped to matingly to receive a generally hemispherical surface of a fastener; and the fastener having an aperture with corresponding threads to receive the threaded member, the fastener further including a handle portion sized to be grasped in the palm of a user's hand to slidably move the fastener along the threaded member between a secured position in which the fastener is received in the receptacle, and an unsecured position in which the fastener is spaced from the receptacle.

2. The device of claim 1, wherein the handle portion includes a plurality of ridges.

3. The device of claim 1, wherein the handle portion has a generally frusto-conical shape.

4. The device of claim 3, wherein the handle portion includes a plurality of ridges.

5. The device of claim 1, wherein the fastener includes a nut portion to allow a user to tighten the fastener with a wrench.

6. The device of claim 5, wherein the nut portion is the shape of a hex nut.

7. The device of claim 1, wherein the fastener is a threaded eye bolt having a loop portion and a threaded portion having the corresponding threads, the loop portion being pivotably connected to the first enclosure portion.

8. The device of claim 7, wherein the loop portion is pivotably connected to the first enclosure portion via a bolt.

9. The device of claim 1, wherein the receptacle includes a cavity in fluid communication with the opening.

10. The device of claim 1, wherein the first and second structures are first and second enclosure portions, respectively, that at least partially define an enclosure therebetween.

11. A housing, comprising:

a first enclosure portion and a second enclosure portion moveably connected to the first enclosure portion between a secured position and an unsecured position, the first enclosure portion and the second enclosure portion together configured to enclose communications equipment while supported along an aerial cable;

a threaded member movably attached to the first enclosure portion;

a receptacle attached to the second enclosure portion, the receptacle defining an opening shaped to matingly to receive a portion of a fastener when the second enclosure portion is in the closed position; and the fastener having an aperture with corresponding threads to receive the threaded member, the fastener further including a handle portion sized to be grasped in the palm of a user's hand to slidably move the fastener along the threaded member between a secured position in which the fastener is received in the receptacle, and an unsecured position in which the fastener is spaced from the receptacle.

12. The housing of claim 11, wherein the first and second enclosure portions are movably connected such that at least one of the first and second enclosure portions moves between a closed position in which the first and second enclosure portions are adjacent to each other to at least partially define an enclosure therebetween, and an open position in which the first and second enclosure portions are spaced from each other relative to the closed position.

* * * * *